United States Patent [19]

Martino et al.

[11] 4,429,982

[45] Feb. 7, 1984

[54] APPARATUS AND METHOD FOR PROCESSING STABILIZATION PHOTOGRAPHIC PAPER

[75] Inventors: Peter V. Martino, Rego Park; Peter Meyers, New York, both of N.Y.

[73] Assignee: Pluribus Products, Inc., Brooklyn, N.Y.

[21] Appl. No.: 366,696

[22] Filed: Apr. 8, 1982

[51] Int. Cl.[3] ..... G03D 5/06

[52] U.S. Cl. ..... 354/318; 354/319; 354/324; 430/405; 430/963

[58] Field of Search ..... 354/318, 319, 320, 321, 354/322, 324; 134/64 P, 122 P; 118/223, 224; 430/405, 963

[56] References Cited

U.S. PATENT DOCUMENTS

| | | | |
|---|---|---|---|
| 3,107,596 | 10/1963 | Arnold et al. | 354/318 |
| 3,345,174 | 10/1967 | Dotson et al. | 430/405 |
| 3,465,663 | 9/1969 | Calder | 354/318 |
| 3,593,641 | 7/1971 | Adams et al. | 354/317 |
| 3,682,079 | 8/1972 | Casson | 354/318 |
| 3,903,541 | 9/1975 | Von Meister et al. | 354/317 |
| 4,030,924 | 6/1977 | Hofman | 430/405 |
| 4,213,420 | 7/1980 | Martino | 354/318 |
| 4,303,330 | 12/1981 | Hehn et al. | 134/64 P |

FOREIGN PATENT DOCUMENTS

| | | | |
|---|---|---|---|
| 820888 | 9/1959 | United Kingdom | 354/318 |

*Primary Examiner*—A. A. Mathews

*Attorney, Agent, or Firm*—Anthony J. Casella; Gerald E. Hespos

[57] ABSTRACT

A stabilization processor is provided having activator, stop, stabilizer and rinse baths sequentially arranged therein. A plurality of pairs of upper and lower rollers are provided with at least one pair being disposed in each bath. The upper rollers in each pair of rollers is driven by a worm gear, while the lower roller is driven by frictional coaction with the upper rollers and the stabilization paper. The movement of the rollers urges the stabilization paper through the stabilization processor. The rotation of the lower roller transports the chemical solution in each bath into contact with the stabilization paper. The stop bath assures no contamination of the stabilizer bath by the activator solution. A pumping and recirculation system is provided for each bath. The recirculation system enables complete draining of the stabilization processor during periods of non-use.

14 Claims, 5 Drawing Figures

APPARATUS AND METHOD FOR PROCESSING STABILIZATION PHOTOGRAPHIC PAPER

BACKGROUND OF THE INVENTION

Stabilization processors produce a photographic image on a photographically exposed stabilization paper that has been impregnated with developing agents during manufacture. Stabilization processors have several desirable operational features. For example, stabilization processors are small, reasonably inexpensive, and are able to produce photographic prints quickly and inexpensively. Stabilization processors are particularly well adapted to photo-type setting operations and other production environments where it is desirable to quickly produce a reasonably good quality print.

Briefly, prior art stabilization processors include two baths disposed adjacent one another. One bath of the prior art processor contains an activator solution, and the other a stabilizer solution. At least one pair of rollers is provided for each bath. The rollers are disposed parallel to one another and either in contact or separated by a distance less than the thickness of the stabilization paper. At least one roller in each pair of rollers is partially submerged in the solution in the bath. A mechanical driving device is provided to rotate the rollers.

Prior art stabilization processors operate by inserting exposed stabilization paper between the rollers in the activator bath. The rotation of the rollers then performs two functions. First, the lower roller partially submerged in the activator solution, picks up activator solution as it rotates and causes the activator solution to contact the stabilization paper. Second, the rotational movement of the rollers urges the stabilization paper through the stabilization processor.

As the activator solution transported by the lower roller in the activator bath of the prior art processor contacts the stabilization paper, developing agents in the stabilization paper are activated to produce a photographic image thereon. Next, the stabilization paper advances to the stabilizer bath, which also includes at least one pair of rollers having the bottom roller partially submerged in the stabilizer solution. As in the activator bath of the prior art stabilization processor, the lower roller in the stabilizer bath picks up stabilizer solution and brings it into contact with the stabilization paper. The stabilizer solution stops additional development of the emulsion on the stabilization paper. The product which exists from the stabilization processor is a completed print that has been produced typically in a matter of a few seconds.

Despite the many potential advantages of stabilization processors, they have certain shortcomings. One of the latter pertains to contamination of the stabilizer solution by the activator solution. Specifically, as the stabilization paper passes through the activator bath the rollers therein deposit activator solution on the stabilization paper. Then, in the prior art stabilization processor, the stabilization paper passes directly into the stabilizor bath. However, as the stabilization paper passes into the stabilizer bath, it carries with it a certain amount of activator solution. This activator solution is picked up by the rollers in the stabilizer bath of the prior art stabilization processor, and as the rollers rotate this excess activator solution mixes in with stabilizer solution in the stabilizer bath. This mixture of the activator and stabilizer solutions generates an annoying ammonia smell, and also affects the ability of the stabilizer solution in the prior art processor to properly react with the stabilization paper. As a result, after a short period of operation, the prior art stabilization processor produces gray, sticky pictures having a short life.

The contamination of the stabilizer solution by the activator solution in the prior art stabilization processor also causes the rollers in the stabilizer bath to acquire a tacky or adhesive characteristic. As a result, adjacent rollers in the stabilizer bath of the prior art stabilization processor tend to adhere to one another. This is especially likely to occur if the prior art stabilization processor is turned off for an extended period of time such as overnight or over a weekend. When the rollers adhere to one another, they are unable to freely rotate, and thus create a substantial resistance on the motor. On many occasions this resistance significantly damages the motor of the prior art stabilization processor. To avoid damage to the motor, the prior art stabilization processor must be manually drained and cleaned at the end of each day.

Accordingly, it is an object of the subject invention to provide a stabilization processor for producing photographic prints of an improved quality.

It is another object of the subject invention to provide a stabilization processor that produces good quality photographic prints without substantially increasing the size or cost of the stabilization processor.

It is an additional object of the subject invention to provide a stabilization processor that produces a good quality photographic print quickly.

It is yet another object of the subject invention to provide a stabilization processor that will eliminate contamination between the activator and stabilizer baths.

An additional object of the subject invention is to provide a stabilization processor that provides acceptably pure solutions in each bath.

It is a further object of the subject invention to provide a stabilization processor which eliminates the potential adhesion between adjacent rollers.

It is still another object of the subject invention to provide a stabilization processor which eliminates the possibility of damage to the driving motor.

It is a further object of the subject invention to provide a stabilization processor which operates without annoying odors.

It is still a further object of the subject invention to provide a stabilization processor that produces a photographic print that has neither gray nor sticky characteristics.

SUMMARY OF THE INVENTION

The subject stabilization processor includes at least three and preferably four adjacent baths. The baths accommodate respectively activator solution to activate the developing agent in the stabilization paper, stop solution to neutralize the activator solution, and stabilizer solution to halt development of the developing agent in the stabilization paper. A fourth bath with a rinse solution to rinse the stabilizer solution from the stabilization paper also can be provided. The stop solution is disposed intermediate and adjacent the activator and stabilizer baths. Thus, any activator solution that remains on the stabilization paper is neutralized prior to the advancement of the stabilization paper to the stabilizer bath. This avoids the contamination of the stabilizer solution by the activator solution.

The stabilization paper is advanced through the subject stabilization processor by a plurality of parallel pair of parallel rollers. Each pair includes an upper and lower roller, with the lower roller in each pair being suspended from the upper roller. The rollers in each pair are either in contact or are separated by a distance less than the thickness of the paper. A worm gear engages gears disposed on one end of each upper roller, such that rotation of the worm gear causes simultaneous rotation of each upper roller. Frictional cooperation between the upper rollers, the stabilization paper, and the lower rollers causes the stabilization paper to advance through the stabilization processor and simultaneously causes rotation of the lower rollers. All of the rollers in the subject stabilization processor are of substantially equal dimensions. Additionally, the rollers are disposed in close proximity to one another. Thus, the stabilization paper is advanced through the stabilization processor in a straight line without the need for extraneous guides.

The lower rollers are partially immersed in either the activator, stop, stabilizer, or rinse solutions. Thus, as the lower rollers rotate they transport appropriate solution into contact with the stabilization paper, thereby causing a desired chemical reaction to take place on the stabilization paper. Each lower roller is provided with an outer covering, such as an elastomer, which readily picks up and transports the associated solution into contact with the stabilization paper. Additionally, the upper and lower rollers are manufactured from dissimilar materials to minimize the possibility of adhesion between rollers.

Each bath is provided with a pumping and recirculation system. This system provides a large reservoir of solution thereby further minimizing the effects of contamination between adjacent baths. Additionally, the agitation caused by the pumping mechanism helps to clean the lower rollers and enables a shorter processing time. Furthermore, the subject pumping and recirculation system enables a complete and automatic draining of the subject stabilization processor during all periods of non-use.

The subject stabilization processors can be adapted to include a dryer for removing all liquid solution from the developed stabilization paper.

DETAILED DESCRIPTION OF THE PREFERRED EMBODIMENT

Figure 1:
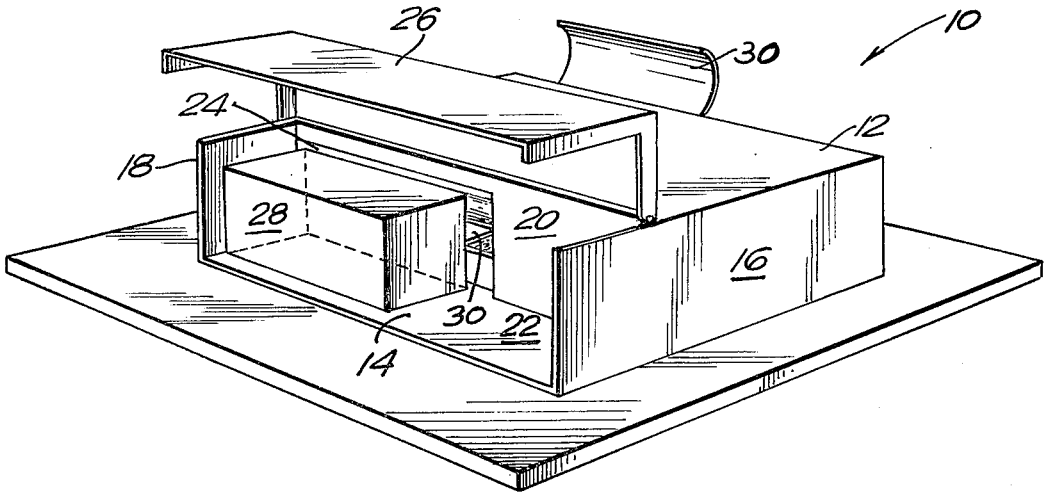
FIG. 1 is a perspective view of the subject stabilization processor showing its outer covering and a paper containing cassette.

The subject stabilization processor, indicated generally by the numeral 10 in FIG. 1, is a generally rectangular structure. Stabilization processor 10 includes outer cover 12 which preferably is constructed from a metallic or plastic material. Outer cover 12 protects the user of the stabilization processor 10 from injury caused by inadvertent contact with moving parts, and assures that there will be no unintentional exposure of the light sensitive material during the processing.

Outer cover 12 of stabilization processor 10 includes paper receiving portions 14. More particularly, paper receiving portion 14 is partially enclosed by side walls 16 and 18, front wall 20 and bottom wall 22 of outer cover 12. Front wall 20 includes a substantially rectangular open portion 24 into which exposed paper may be fed. Light protective door 26 is hingedly connected to outer cover 12 at the uppermost portion of front wall 20 thereof. Light protective door 26 can hingedly rotate into a position so as to completely enclose paper receiving portion 14.

Paper cassette 28 is a non-translucent box for holding exposed stabilization paper 30. Typically, stabilization paper 30 is stored on a reel within paper cassette 28. Paper cassette 28 is dimensioned to fit entirely within paper receiving portion 14 of outer cover 12. As shown in FIG. 1, paper cassette 28 is placed in paper receiving portion 14 and stabilization paper 30 is fed therefrom into rectangular opening 24 and through stabilization processor 10.

Figure 2:
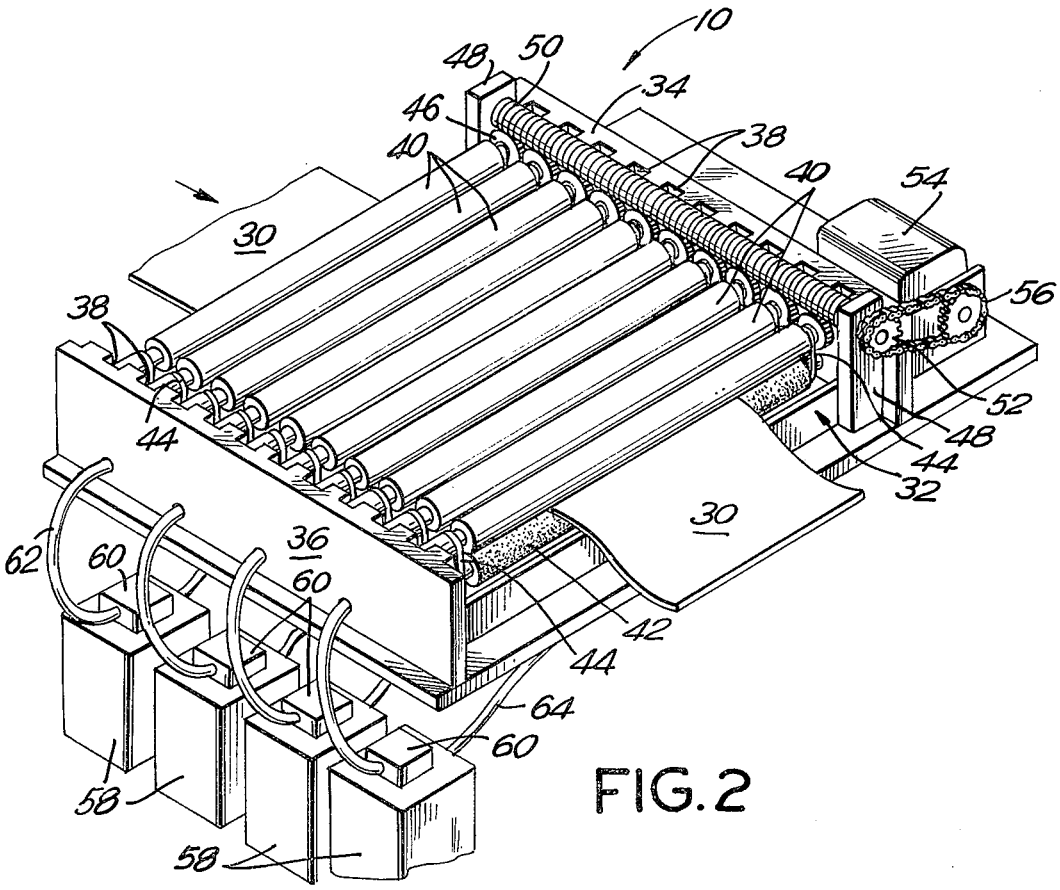
FIG. 2 is a perspective view of the subject stabilization processor having the outer covering portion removed therefrom.

Turning to FIG. 2, stabilization processor 10 is shown with outer cover 12 removed. Stabilization processor 10 includes multi-bath assembly 32 which comprises four separate baths as explained in detail below. Multi-bath assembly 32 includes opposed parallel side walls 34 and 36. Each opposed multi-bath assembly side wall 34 and 36 includes ten roller mounting notches 38. The roller mounting notches 38 in each side wall 34 and 36 are equally spaced from one another, and are aligned so that ten pairs of opposed roller mounting notches 38 are provided.

One upper roller 40 is mounted in each pair of opposed roller mounting notches 38. Upper rollers 40 may be manufactured from any of a variety of materials; however, a plastic PVC material has been found to have desirable operational characteristics.

A lower roller 42 is provided for each upper roller. Lower rollers 42 are constructed from a material dissimilar to that of upper rollers 40, and preferably have a stainless steel core and an elastomer outer covering. Each lower roller 42 is suspended from its respective upper roller 40 by end bands 44. End bands 44 may be rubber belts, such as fan belts, or loop springs. End band 44 function to keep each lower roller 42 adjacent to its respective upper roller 40, and to enable rotational movement therebetween. All upper and lower rollers 40 and 42 have substantially equal diameters to ensure linear movement of stabilization paper 30.

Mounted on one end of each upper roller 40 is roller gear 46, with the roller gears 46 being mutually colinear. Worm gear mounts 48 are affixed to side wall 34 of multi-bath assembly 32, and are aligned with roller gears 46. Worm gear 50 is rotationally mounted in worm gear mounts 48, and engages each of the ten roller gears 46. Driving gear 52 is mounted on one end of worm gear 50, and electric motor 54 is mounted adjacent side wall 34 of multi-bath assembly 32. Drive chain 56 extends from electric motor 54 to driving gear 52. By this interconnection, electric motor 54 rotates worm gear 50, which in turn cooperates with roller gears 46 to rotate upper rollers 40. As mentioned above, the gap, if any, between upper and lower rollers 40 and 42 is preferably less than the thickness of stabilization paper 30. Thus, as stabilization paper 30 is inserted between upper and lower rollers 40 and 42 of stabilization processor 10, the rotational movement of upper rollers 40 causes stabilization paper 30 to advance through stabilization processor 10 and also causes rotational movement of lower rollers 42.

Four liquid tanks 58 and associated pump 60, are in communication with multi-bath assembly 32 of stabilization processor 10. More specifically, each combination of a liquid tank 58 and a pump 60 includes a feed line 62 and a return line 64. Feed line 62 and return line 64 each communicate with multi-bath assembly 32 of stabilization processor 10 as described in further detail below.

Figure 3:
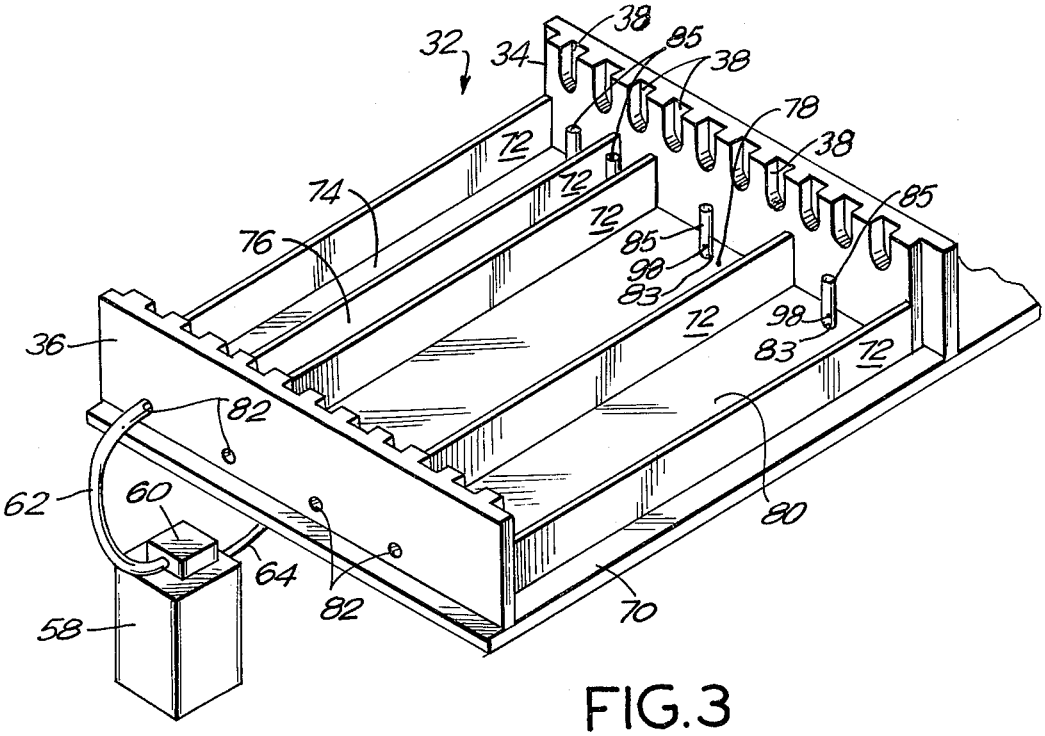
FIG. 3 is a perspective view of the subject stabilization processor with the rollers removed therefrom.

As shown in FIG. 3, multi-bath assembly 32 includes a bottom surface 70 which is fixedly attached to side walls 34 and 36 thereof. Multi-bath assembly 32 also includes a plurality of bath dividers 72. Each bath divider 72 is perpendicular to and fixedly connected to side walls 34 and 36 of multi-bath assembly 32. Additionally, bath dividers 72 are perpendicular to and fixedly connected to the bottom surface 68 of multi-bath assembly 32. The connections of bath dividers 72 to bottom surface 70 and side walls 34 and 36 of multi-bath assembly 32 are liquid impervious. The five bath dividers 72 are disposed along side walls 34 and 36 of multi-bath assembly 32 so as to define activator bath 74, stop bath 76, stabilizer bath 78, and rinse bath 80. More particularly, bath dividers 72 are located such that activator bath 74 includes two pairs of rollers, stop bath 76 includes one pair of rollers, stabilizer bath 78 includes four pairs of rollers and rinse bath 80 includes three pairs of rollers.

Side wall 36 of multi-bath assembly 32 includes four feed apertures 82 which extend through side wall 36 at a location thereon slightly above bottom surface 70. Feed apertures 82 are disposed along side wall 36 of multi-bath assembly 32 such that one feed aperture 82 extends into each bath 74, 76, 78, and 80. Each feed line 62 extends from a pump 60 to a feed aperture 82, so that liquid from the associated liquid tank 58 can be pumped into the appropriate bath 74, 76, 78 or 80, as explained below.

Each bath 74, 76, 78, and 80 contains a drain 83. More specificatlly, drains 83 extend through bottom surface 70 of multi-bath assembly 32. Extending from each drain 83 into the associated bath 74, 76, 78 or 80 are stand pipes 85. The length of each stand pipe 85 is a function of the desired depth of liquid in the baths 74, 76, 78, and 80. Return lines 64 connect to stand pipe 85 at drains 85 and extend therefrom to liquid tanks 58. Thus, liquid from liquid tank 58 is urged by pump 60 through feed line 62 and into the appropriate baths 74, 76, 78 or 80. When the liquid in bath 74, 76, 78 or 80 reaches the height of stand pipes 85, the liquid will flow through stand pipes 85, through drains 83 and return line 64 and back into liquid tanks 58. Thus, a continuous recirculation of liquid in baths 74, 76, 78, and 80 is provided for.

Figure 4:
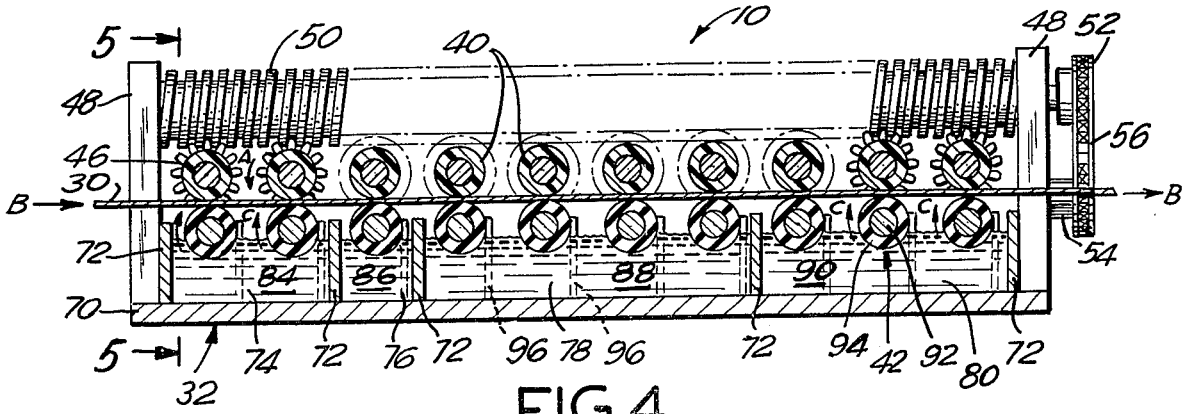
FIG. 4 is a cross-sectional side view of the subject stabilization processor.

FIG. 4 illustrates the subject stabilization processor 10 in operation. More particularly, activating bath 74 includes activating liquid 84. Similarly, stop bath 76 includes stop liquid 86, stabilizer bath 78 includes stabilizer solution 88 and rinse bath 80 includes rinse 90. The level of liquid 84, 86, 88, and 90 in each bath 74, 76, 78, and 80 is substantially the same, reflecting the fact that stand pipes 85 are of substantially equal length.

Upper rollers 40 all lie in a plane that is parallel to bottom surface 70 of multi-bath assembly 32. Similarly, lower rollers 42 all lie in a common plane that is parallel to bottom surface 70 of multi-bath assembly 32. Each lower roller 42 includes a stainless steel core 92 and an elastomer outer surface 94. Additionally, the plane defined by the lower rollers 42 is disposed such that each lower roller 42 is partially submerged in the liquid 84, 86, 88 and 90 in the baths 74, 76, 78 and 80 respectively.

In operation, electric motor 54 causes movement of chain 56 which, acting through driving gear 52, rotates worm gear 50. Worm gear 50 in turn cooperates with roller gears 46, on each upper roller 40 causing upper rollers to rotate in the direction indicated by arrows A. Stabilization paper 30 is inserted into stabilization processor 10 in the direction indicated by arrows B. The rotation of upper rollers 40 in the direction indicated by arrow A continues to urge stabilization paper 30 in the direction indicated by arrows B. Additionally, the frictional contact between upper rollers 40, stabilization paper 30, and lower rollers 42 causes lower rollers 42 to rotate in the direction indicated by arrows C. As lower rollers 42 rotate in the direction indicated by arrow C, the elastomer outer surface 94 thereof moves through and transports liquid 84, 86, 88 or 90 from baths 74, 76, 78, or 80 respectively. The liquid transported by the elastomer outer surface 94 of each lower roller 42 is brought into contact with stabilization paper 30 causing an appropriate desired reaction as explained further below.

As stabilization paper 30 passes above activator bath 74, the elastomer outer surface 94 of the two lower rollers 42 therein transport the activator solution in activator bath 74 toward stabilization paper 30. The two lower rollers 42 in activator bath 74 "kiss" stabilization paper 30 to activate the developing agents thereon. Although the stabilization paper 30 is not immersed in liquid, a small amount of activator solution may remain on stabilization paper 30 as it advances through stabilization processor 10. However, since the stop bath 76 with an acetic acid stop solution 86 therein is located adjacent to the activator bath 74 and between the activator and stabilizer bath 74 and 78, as the lower roller 42 in the stop bath 76 rotates through the stop bath solution 86, the stop bath solution 86 is transported by the elastomer outer surface 94 of the lower roller 42, and is brought into contact with stabilization paper 30, and, by this cooperation, the stop bath solution 86 neutralizes whatever activator solution 84 remains on stabilization paper 30 after stabilization paper 30 passes activator bath 74. Thus, the activator solution 84 does not contaminte stabilizer solution 88. This also obviates the possibility of the development of the annoying ammonia smell, and also avoids potential adhesion between upper and lower rollers 40 and 42 in stabilizer bath 78. Additionally, the stabilizer solution 88 applied to stabilization paper 30 is maintained uncontaminated, and consequently, prints produced by the subject stabilization processor 10 are neither gray nor tacky.

As the stabilization paper 30 passes through stabilization processor 10 in the direction indicated by arrow B, the stabilizer solution 88 in stabilizer bath 78 is brought into contact with stabilization paper 30 thereby stopping additional emulsion development. As mentioned above, whatever activator solution 84 that had been carried by stabilization paper 30 had been neutralized by the stop bath solution 86 as the stabilization paper 30 passed through stop bath 76. Thus, there will be no mixing of activator solution 84 and stabilizer solution 88 in the stabilizer bath 78.

Rinse bath 80 is located adjacent stabilizer bath 78 and includes three pairs of upper and lower rollers 40 and 42. A rinse solution 90, such as Hypo-eliminator or Perma-wash, is disposed in rinse bath 80. As in the previous baths, lower rollers 42 rotate in the direction indicated by arrows C. The elastomer outer surface 94 of lower rollers 42 transport the rinse solution to stabilization paper 30, thereby causing a rinsing of the stabilization solution 88 on stabilization paper 30. This rinsing, it has been discovered, further eliminates stickiness of the finished print and extends the life of the print. The upper and lower rollers 40 and 42 in rinse bath 80 most distant from activator bath 74 can be slightly larger than the other rollers 40 and 42 to create a drag that will remove excess liquid.

Figure 5:
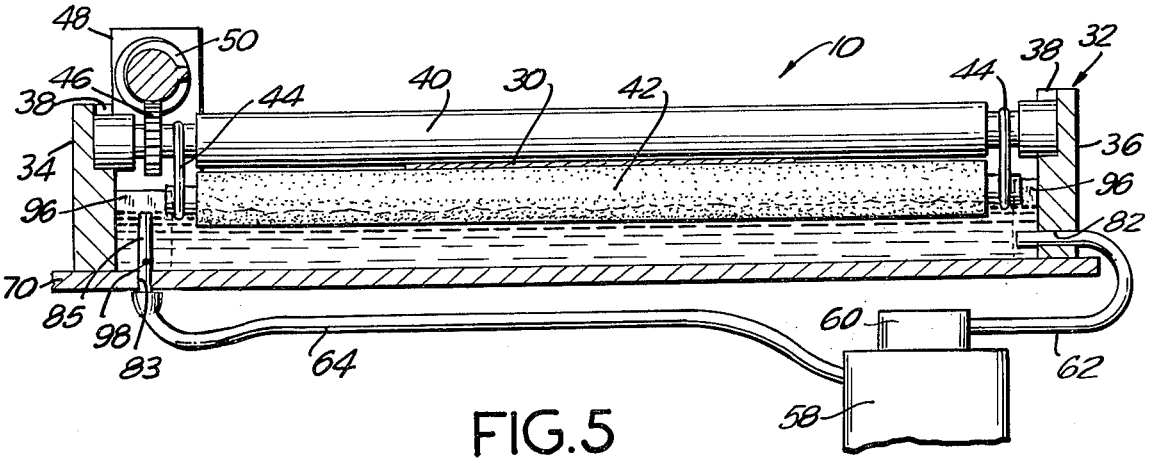
FIG. 5 is a cross-sectional end view of the subject stabilization processor taken along line 5—5 indicated in FIG. 4.

As explained above, and as shown most clearly in FIGS. 2 and 5, lower rollers 42 are hung from and biased toward upper rollers 40 by end bands 44. When stabilization processor 10 is not operating, gravity will insure that each lower roller 42 will remain in the same vertical plane as its corresponding upper roller 40. To further insure that lower rollers 42 remain in vertical plane with their respective upper rollers 40 during operation of stabilization processor 10, lower roller stops 96 are provided extending from side walls 34 and 36 and contacting the end portions of each lower roller 42 as shown in FIGS. 4 and 5. Lower roller stops 96 operate to ensure that the tangential forces exerted on lower rollers 42 cause lower rollers 42 to rotate in the direction indicated by arrows C without having the center of lower rollers 42 move in the direction indicated by arrow B. This constant vertical alignment of each pair of upper and lower rolles 40 and 42 is required to ensure that stabilization paper 30 moves in a straight line rather than curving upwardly.

As shown in FIG. 5, pump 60 is attached to and in communication with liquid tank 58. The type of liquid in liquid tank 58, of course would depend upon the particular bath to which pump 60 and liquid tank 58 are connected. Feed line 62 extends from pump 60 through feed aperture 82 in side wall 36. As mentioned above, feed aperture 82 is located near the lowermost portion of side wall 36. Drain 83 extends through bottom surface 70 of multi-bath assembly 32, and into each bath 74, 76, 78, or 80 near side wall 34. Stand pipe 85 extends through drain 83. Return line 64 connects to stand pipe 85 at drain 83, and extends therefrom to liquid tank 58. More specifically, stand pipe 85 extends upwardly from bottom surface 70 of multi-bath assembly 32 a distance that is greater than the distance from bottom surface 70 to lower roller 42. Thus, pump 60 will urge liquid into multi-bath assembly 32 to a level sufficient to enable lower rollers 42 to be partially immersed in liquid. However, once the liquid in multi-bath assembly 32 reaches the height of stand pipe 85, the liquid will drain off through stand pipe 85 and return line 64 to liquid tank 58.

This recirculation system as shown most clearly in FIG. 5 accomplishes several objectives. First, it increases the total volume of each type of chemical solution, thereby minimizing the effect of any cross contamination of chemical solution between adjacent baths. Second, it has been found that the continuous movement of the activator solution 84 within the activator bath 74 and the stabilizer solution 88 within the stabilizer bath 78 enables each of these chemicals to act more quickly on stabilization paper 30. As a result, the speed at which stabilization paper 30 may be advanced through stabilization processor 10 may be increased. Third, the agitation of the solutions caused by pumps 60 causes continuous cleaning of lower rollers 42. Fourth, the recirculation system shown in FIG. 5 enables automatic reliable draining of multi-bath assembly 32 during all periods of non-use. Specifically, a weep hole 98 is provided in each stand pipe 85 slightly above bottom surface 70 of multi-bath assembly 32. The cross-sectional area of weep hole 98 is significantly smaller than the cross-sectional area of feed line 62. Furthermore, the rate of flow of fluid urged through feed line 62 by pump 60 is substantially greater than the rate of flow of fluid through weep hole 98. Thus, when the system is operating, pumps 60 will urge fluid into baths 74, 76, 78, and 80 faster than the liquid is drained through weep holes 98. Consequently, each bath will fill to the height of stand pipe 85 after which additional liquid will pass through stand pipe 85 and return line 64. However, when pump 60 is not operating, the liquid solutions in each bath 74, 76, 78, or 80 will drain through weep holes 98 and return lines 64. By thus ensuring complete draining of multi-bath assembly 32 during all periods of non-use, the life of the elastomer outer surface 94 of lower rollers 42 is substantially increased. Also, the possibility of upper and lower rollers 40 and 42 becoming adhered to one another is virtually eliminated.

In summary, a stabilizer processor is provided with four adjacent baths. The baths sequentially provide an activator solution, a stop solution, a stabilizer solution, and a rinse. The stabilization processor includes a plurality of upper and lower pairs of rollers. The rollers in each pair are constructed from dissimilar materials selected to minimize the possibility of adhesion between rollers during periods of non-use. At least one pair of rollers is provided in each bath. Gears are provided to simultaneously drive the upper rollers in each pair, and the lower rollers are rotated about their axes by frictional coaction with the stabilization paper and the upper rollers. The lower rollers are so disposed so as to be partially submerged in the liquid solutions in the respective baths. In operation, the upper rollers urge the stabilization paper through the stabilization processor and the stabilization paper in turn frictionally engages the lower rollers causing rotation about their longitudinal axes. As the lower rollers rotate, the liquid in the respective baths is transported into contact with the stabilization paper. The stop solution neutralizes any activator solution that may be carried by the stabilization paper after the stabilization paper leaves the activator bath. This arrangement virtually eliminates contamination of the stabilizer solution by the activator solution. As a result, the stabilization processor operates without an annoying ammonia smell and provides clearer non-sticky prints. The rinse solution further enhances the quality and expected life of the prints. A recirculation and pumping system also is provided to improve the purity of the chemicals in each bath, to enable a shorter processing time, to clean the rollers, and to allow the system to drain automatically during periods of non-use.

While the preferred embodiments of the subject invention has been described and illustrated, it is obvious that various changes and modifications can be made therein without departing from the spirit of the present invention which should be limited only by the scope of the appended claims.

We claim:

1. A stabilization processor for developing stabilization paper, and stabilization processor comprising:

(a) a multi-bath assembly including a bottom surface, opposed parallel upstanding side walls and a plurality of upstanding dividers affixed perpendicular to said side walls and defining in turn, an activator bath for storing activator solution to activate developing agents in said stabilization paper for developing prints on said stabilization paper, a stop bath for storing a neutralizing solution for neutralizing said activator solution, a stabilizer bath for storing stabilizer solution to halt development of said stabilization paper, a rinse bath for storing a rinse solution, said rinse bath being disposed adjacent the stabilizer bath in said multi-bath assembly;

(b) a plurality of parallel pairs of rollers, each said pair of rollers comprising a parallel arrangement of an upper roller and a lower roller, said pairs of rollers extending between and rotatably mounted on said multi-bath assembly side walls, said upper and lower rollers of said plurality of pairs of rollers defining respectively upper and lower planes disposed parallel to said bottom surface, at least one pair of rollers being disposed in each said activator, stop, stabilizer and rinse bath, said lower rollers further being disposed such that at least a portion of each said lower roller is immersed in said activator, neutralizer, stabilizer or rinse solutions when said solutions are placed in said multi-bath assembly, and wherein the lower roller in each said pair of rollers is suspended from the upper roller in said pair of rollers by end bands, said end bands defining biasing loops mounted over both said upper and lower rollers in each said pair of rollers, to bais said rollers in each pair together; and (c) a roller driving mechanism for causing rotation of at least one roller in each said pair of rollers.

2. A stabilization processor as in claim 1 wherein said upper and lower rollers are constructed from dissimilar materials.

3. A stabilization processor as in claim 2 wherein said upper roller is constructed from a hard plastic material.

4. A stabilization processor as in claim 3 wherein each said lower roller has a stainless steel axially aligned core portion and an elastomer outer surface.

5. A stabilization processor as in claim 1 wherein a roller gear is mounted on one end of each said upper roller, said roller gears on said upper rollers being colinear with one another, and wherein said roller driving mechanism comprises a motor and a worm gear, said worm gear engaging said roller gear on each said upper roller and being rotationally driven by said motor, said lower rollers in each said pair of rollers being rotated by frictional cooperation with said upper rollers.

6. A stabilization processor as in claim 1 wherein said activator, stop, stabilizer, and rinse bath in said multi-bath assembly each are in communication with a separate pumping and recirculation system, said pumping and recirculation systems being operative to continuously recycle the solution in said baths.

7. A stabilizer processor as in claim 6 wherein each said recirculation system comprises a solution storage tank, a pump for urging solution out of said solution storage tank, a feed line extending from said pump to the associated bath for accommodating the flow of solution from said pump to said bath, and a return line extending from said bath to said liquid storage tank.

8. A stabilization processor as in claim 7 wherein each said bath includes a stand pipe drain connected to said return line and extending into said bath for a distance corresponding to the desired level of the solution in said bath.

9. A stabilization processor as in claim 8 wherein each said stand pipe includes a weep hole, said weep hole being of smaller diameter than said feed line, said weep hole enabling its associated bath to drain automatically when said pump is not operative.

10. A stabilization processor as in claim 1 wherein said activator bath includes two pairs of rollers, said stop bath includes one pair of rollers, said stabilizer bath includes four pairs of rollers, and said rinse bath includes three pairs of rollers.

11. A stabilization processor as in claim 5 wherein said worm gear simultaneously drives each said upper roller.

12. A stabilization processor as in claim 1 wherein the pair of rollers in said rinse bath most distant from said activator bath have a slightly larger diameter than the other rollers in said stabilization processor, said slightly larger diameter pair of rollers being operative to remove excess solution from said stabilization paper.

13. A stabilization processor for developing stabilization paper, said stabilization processor comprising:

(a) a multi-bath assembly including a bottom surface, opposed parallel upstanding side walls and a plurality of upstanding dividers affixed perpendicular to said side walls and defining in turn, an activator bath for storing activator solution to activate developing agents in said stabilization paper for developing prints on said stabilization paper, a stop bath for storing a neutralizing solution for neutralizing said activator solution, a stabilizer for storing stabilizer solution to halt development of said stabilization paper, a rinse bath for storing a rinse solution, said rinse bath being disposed adjacent the stabilizer bath in said multi-bath assembly;

(b) a plurality of parallel pairs of rollers, each said pair of rollers comprising a parallel arrangement of an upper roller and a lower roller, said pairs of rollers extending between and rotatably mounted on said multi-bath assembly side walls, said upper and lower rollers of said plurality of pairs of rollers defining respectively upper and lower planes disposed parallel to said bottom surface, at least one pair of rollers being disposed in each said activator, stop, stabilizer and rinse bath, said lower rollers further being disposed such that at least a portion of each said lower roller is immersed in said activator, neutralizer, stabilizer or rinse solutions when said solutions are placed in said multi-bath assembly, and wherein said activator, stop, stabilizer, and rinse bath in said multi-bath assembly each are in communication with a separate pumping and recirculation system, said pumping and recirculation systems being operative to continuously recycle the solution in said baths; and (c) a roller driving mechanism for causing rotation of at least one roller in each said pair of rollers.

14. A stabilization processor for developing stabilization paper, said stabilization processor comprising:

(a) a multi-bath assembly including a bottom surface, opposed parallel upstanding side walls and a plurality of upstanding dividers affixed perpendicular to said side walls and defining in turn, an activator bath for storing activator solution to activate developing agents in said stabilization paper for developing prints on said stabilization paper, a stop bath for storing a neutralizing solution for neutraling said activator solution, a stabilizer bath for storing stabilizer solution to halt development of said stabilization paper, a rinse bath for storing a rinse solution, said rinse bath being disposed adjacent the stabilizer bath in said multi-bath assembly;

(b) a plurality of parallel pairs of rollers, each said pair of rollers comprising a parallel arrrangement of an upper roller and a lower roller, said pairs of rollers extending between and rotatably mounted on said multi-bath assembly side walls, said upper and lower rollers of said plurality of pairs of rollers defining respectively upper and lower planes disposed parallel to said bottom surface, at least one pair of rollers being disposed in each said activator, stop, stabilizer and rinse bath, said lower rollers further being disposed such that at least a portion of each said lower roller is immersed in said activator, neutralizer, stabilizer or rinse solutions when said solutions are placed in said multi-bath assembly, and wherein the pair of rollers in said rinse bath most distant from said activator bath have a slightly larger diameter than the other rollers in said stabilization processor, said slightly larger diameter pair of rollers being operative to remove excess solution from said stabilization paper; and (c) a roller driving mechanism for causing rotation of at least one roller in each said pair of rollers.

* * * * *